US011703784B1

(12) United States Patent
Kinoshita

(10) Patent No.: US 11,703,784 B1
(45) Date of Patent: Jul. 18, 2023

(54) FIXING DEVICE

(71) Applicant: TOSHIBA TEC KABUSHIKI KAISHA, Tokyo (JP)

(72) Inventor: Hiroki Kinoshita, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/679,046

(22) Filed: Feb. 23, 2022

(51) Int. Cl.
*G03G 15/20* (2006.01)

(52) U.S. Cl.
CPC ..... *G03G 15/2057* (2013.01)

(58) Field of Classification Search
CPC ..... G03G 15/2057
See application file for complete search history.

(56) References Cited

U.S. PATENT DOCUMENTS

| | | | | |
|---|---|---|---|---|
| 2014/0138372 | A1* | 5/2014 | Ogura | G03G 15/2042 399/329 |
| 2015/0139706 | A1 | 5/2015 | Fujiwara et al. | |
| 2015/0153692 | A1 | 6/2015 | Matsubara et al. | |
| 2015/0261145 | A1 | 9/2015 | Taguchi et al. | |
| 2015/0338803 | A1 | 11/2015 | Hirose et al. | |
| 2018/0173138 | A1* | 6/2018 | Seki | G03G 15/2017 |

* cited by examiner

*Primary Examiner* — Clayton E. La Balle
*Assistant Examiner* — Michael A Harrison
(74) *Attorney, Agent, or Firm* — Kim & Stewart LLP

(57) ABSTRACT

A fixing device includes a tubular body that forms a nip with a pressure member to fix a recording material onto a recording medium, a heater inside the tubular body and facing a heated region of the tubular body in a first direction, and a heat conductive member that has a thermal conductivity larger in a second direction crossing the first direction and parallel to an axial direction of the tubular body than in the first direction. The heat conductive member includes an end portion and a central portion along the second direction, and the end portion has a higher density than the central portion.

17 Claims, 6 Drawing Sheets

FIXING DEVICE

FIELD

Embodiments described herein relate generally to a fixing device and an image forming apparatus.

BACKGROUND

A fixing device for fixing an image onto a recording medium such as a sheet of paper for printing includes a tubular body, a pressing member, a heater, and a heat conductive member. The tubular body forms a nip with the pressing member through which the printing medium passes through. The tubular body is formed in a cylindrical shape. The tubular body fixes a recording material such as toner onto the recording medium in the nip. The heater is disposed inside the tubular body. The heater faces and heats a heated region, which is a part of the surface of the tubular body. The heat conductive member has a larger thermal conductivity in a direction along the axial direction of the tubular body than a thermal conductivity in a direction in which the heater and the heated region face each other.

In an image forming apparatus having such a fixing device, small-sized papers can be continuously printed. As the papers pass through an axial central portion of the tubular body, the heat of the tubular body escapes to the papers and the temperature of the axial central portion of the tubular body drops. If the temperature at the axial central portion of the tubular body drops excessively, a fixing failure may occur. Therefore, the fixing device is required to prevent occurrence of the fixing failure.

DETAILED DESCRIPTION

In general, according to one embodiment, a fixing device includes a tubular body that forms a nip with a pressure member to fix a recording material onto a recording medium, a heater inside the tubular body and facing a heated region of the tubular body in a first direction, and a heat conductive member that has a thermal conductivity larger in a second direction crossing the first direction and parallel to an axial direction of the tubular body than in the first direction. The heat conductive member includes an end portion and a central portion along the second direction, and the end portion has a higher density than the central portion.

Hereinafter, an image forming apparatus 1 according to a first embodiment will be described with reference to the drawings.

Figure 1:
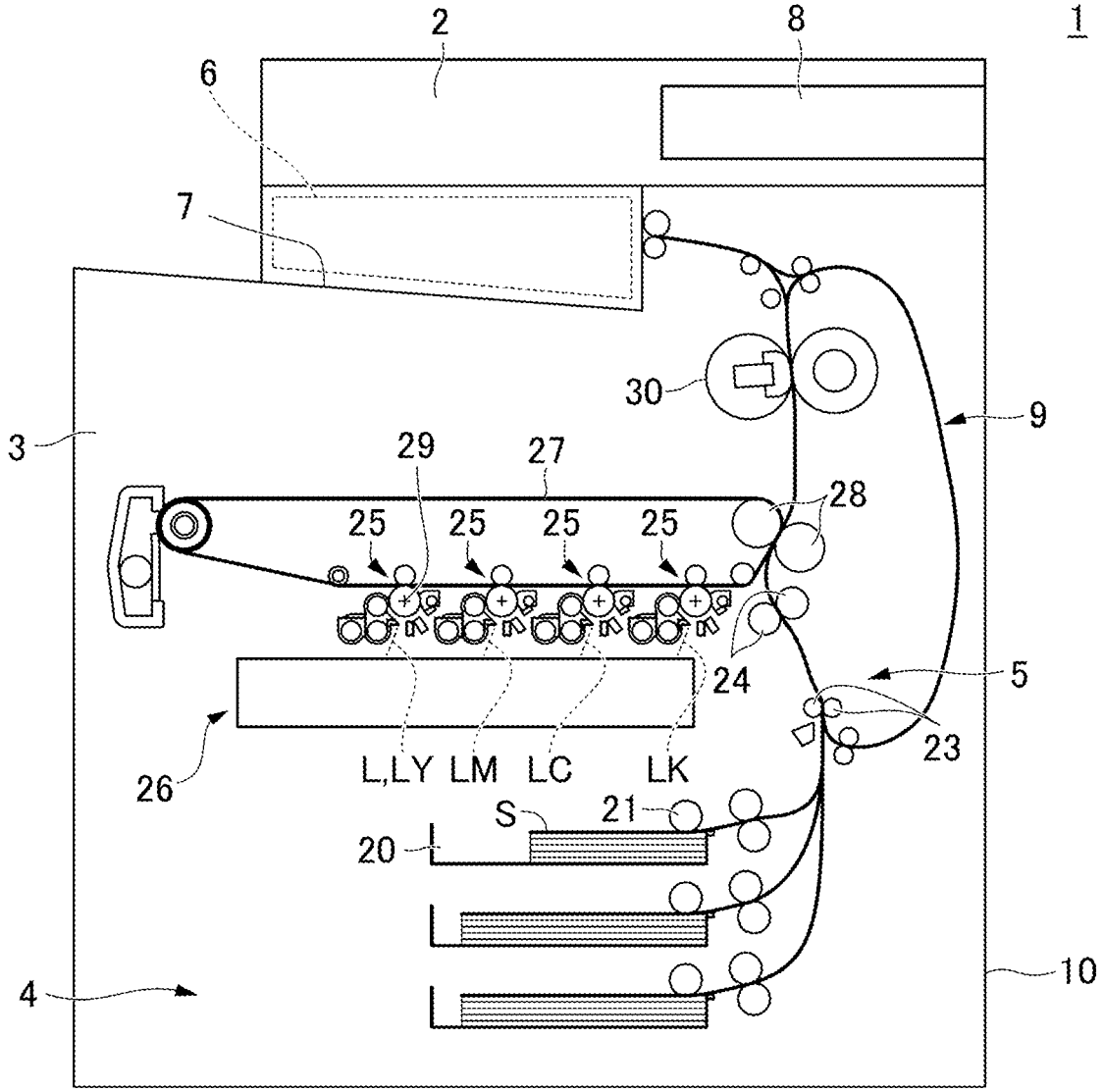
FIG. 1 is a schematic diagram of an image forming apparatus according to a first embodiment.

FIG. 1 is a schematic diagram of the image forming apparatus 1. As illustrated in FIG. 1, the image forming apparatus 1 includes a housing 10, a scanner 2, a printing unit 3, a sheet supply unit 4, a conveyance unit 5, a paper ejection tray 7, an inverting unit 9, a control panel 8, and a controller 6. The image forming apparatus 1 forms an image on a sheet-shaped recording medium (hereinafter referred to as "sheet") such as a paper sheet.

The housing 10 forms an outer shape of the image forming apparatus 1. The housing 10 accommodates various components of the image forming apparatus 1.

The scanner 2 reads an image formed on a sheet to be copied based on brightness and darkness of light and generates an image signal. The scanner 2 outputs the generated image signal to the printing unit 3.

The printing unit 3 forms an output image with a recording material such as toner based on the image signal received from the scanner 2 or an image signal received from the outside. Hereinafter, the output image is referred to as a toner image. The printing unit 3 transfers the toner image onto a surface of the sheet S. The printing unit 3 heats and presses the toner image on the surface of the sheet S to fix the toner image on the sheet S.

The sheet supply unit 4 supplies the sheets S one by one to the conveyance unit 5 at the time when the printing unit 3 forms the toner image. The sheet supply unit 4 includes a sheet accommodation unit 20 and a pickup roller 21.

The sheet accommodation unit 20 accommodates the sheets S of a predetermined size and type.

The pickup roller 21 takes out the sheets S one by one from the sheet accommodation unit 20. The pickup roller 21 supplies the pickup sheet S to the conveyance unit 5.

The conveyance unit 5 conveys the sheet S supplied from the sheet supply unit 4 to the printing unit 3. The conveyance unit 5 has conveyance rollers 23 and registration rollers 24.

The conveyance rollers 23 convey the sheet S supplied from the pickup roller 21 to the registration rollers 24 so that the leading edge of the sheet S in the conveyance direction abuts the nip formed by the registration rollers 24. That is, the registration rollers 24 adjust the position of the leading edge of the sheet S in the conveyance direction by bending the sheet S at the nip. The registration rollers 24 then convey the sheet S according to the timing at which the printing unit 3 transfers the toner image to the sheet S.

The printing unit 3 will be described.

The printing unit 3 includes a plurality of image forming units 25, a laser scanning unit 26, an intermediate transfer belt 27, transfer rollers 28, and a fixing device 30.

Each image forming unit 25 has a photoconductor drum 29. The image forming unit 25 forms a toner image corresponding to the image signal from the scanner 2 or the outside on the photoconductor drum 29. The plurality of image forming units 25 form toner images with yellow, magenta, cyan, and black toners.

A charger, a develop device, and the like are arranged around each photoconductor drum 29. The charger charges the surface of the photoconductor drum 29. The develop devices accommodate developers containing yellow, magenta, cyan, and black toners. Each develop device develops an electrostatic latent image on the corresponding photoconductor drum 29. A toner image of toner of each color is formed on the photoconductor drum 29.

The laser scanning unit 26 scans the charged photoconductor drum 29 with a laser beam L to expose the photoconductor drum 29. The laser scanning unit 26 exposes the photoconductor drums 29 of the image forming units 25 of respective colors with different laser beams LY, LM, LC, and LK. The laser scanning unit 26 forms an electrostatic latent image on the photoconductor drum 29.

The toner image on the surface of the photoconductor drum 29 is primarily transferred to the intermediate transfer belt 27.

The transfer rollers 28 transfer the toner image primarily transferred on the intermediate transfer belt 27 onto the surface of the sheet S at a secondary transfer position.

The fixing device 30 heats and presses the toner image on the sheet S to fix the toner image to the sheet S.

The inverting unit 9 inverts the sheet S in order to form an image on the back surface of the sheet S. The inverting unit 9 flips the sheet S discharged from the fixing device 30 upside down by switchback. The inverting unit 9 conveys the inverted sheet S toward the registration rollers 24.

The sheet S on which an image is formed is discharged onto the paper ejection tray 7.

The control panel 8 is an input device for an operator to input information to operate the image forming apparatus 1. The control panel 8 has a touch panel and various hardware keys or buttons.

The controller 6 controls the functions of the image forming apparatus 1.

Figure 2:
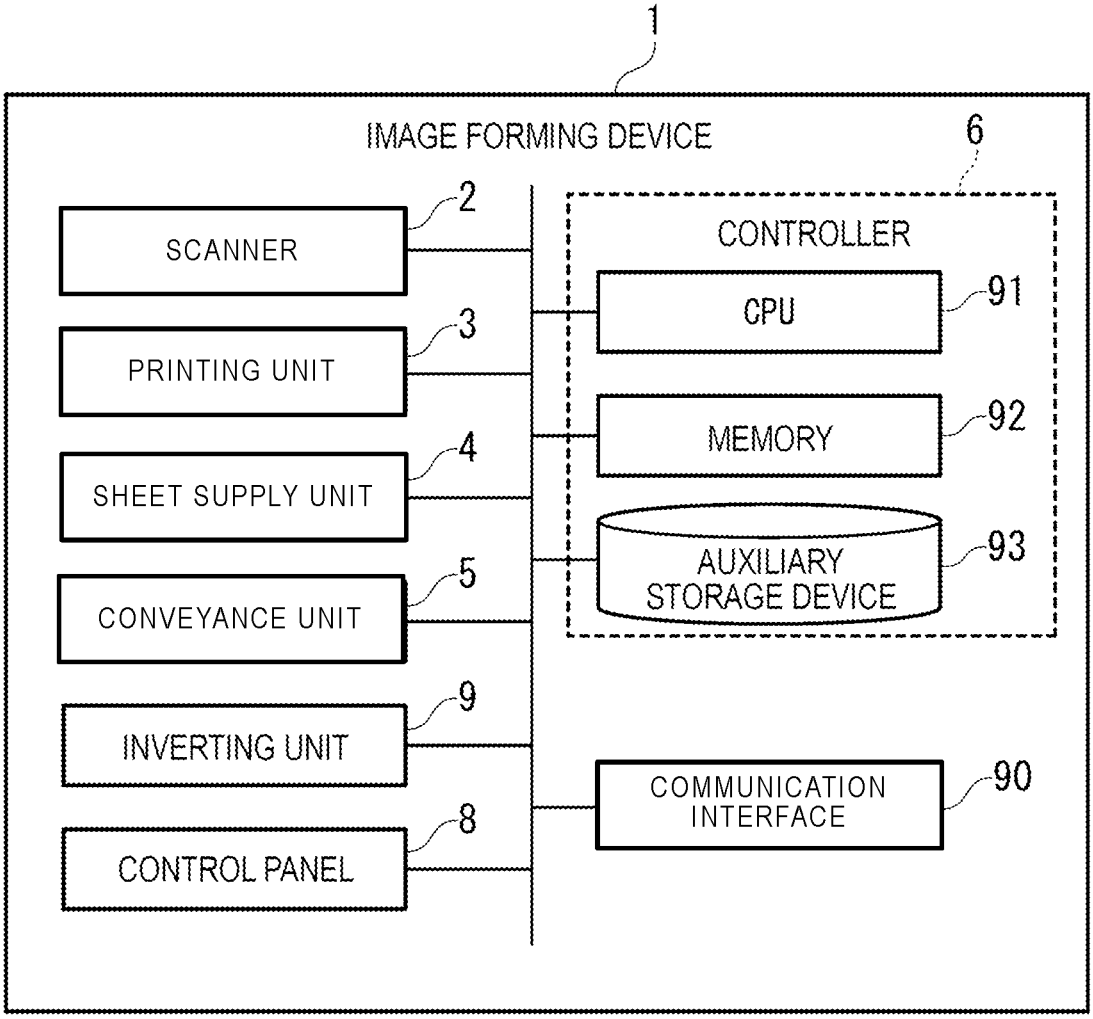
FIG. 2 is a hardware block diagram of an image forming apparatus.

FIG. 2 is a hardware block diagram of the image forming apparatus 1.

As illustrated in FIG. 2, the image forming apparatus 1 includes a Central Processing Unit (CPU) 91, a memory 92, an auxiliary storage device 93, and the like. The CPU 91, the memory 92, the auxiliary storage device 93, and the like are connected to each other by a bus. For example, the CPU 91, the memory 92, and the auxiliary storage device 93 make up the controller 6. The image forming apparatus 1 executes various programs. The image forming apparatus 1 including the scanner 2, the printing unit 3, the sheet supply unit 4, the conveyance unit 5, the inverting unit 9, the control panel 8, and a communication interface 90 operates according to the programs.

The CPU 91 of the controller 6 executes the programs stored in the memory 92 and/or the auxiliary storage device 93. The controller 6 controls the operation of each unit of the image forming apparatus 1.

The auxiliary storage device is a storage device such as a magnetic hard disk device (HDD) or a semiconductor storage device.

The communication interface 90 includes a communication interface circuit for connecting to an external device via a network.

The fixing device 30 will be described in detail.

Figure 3:
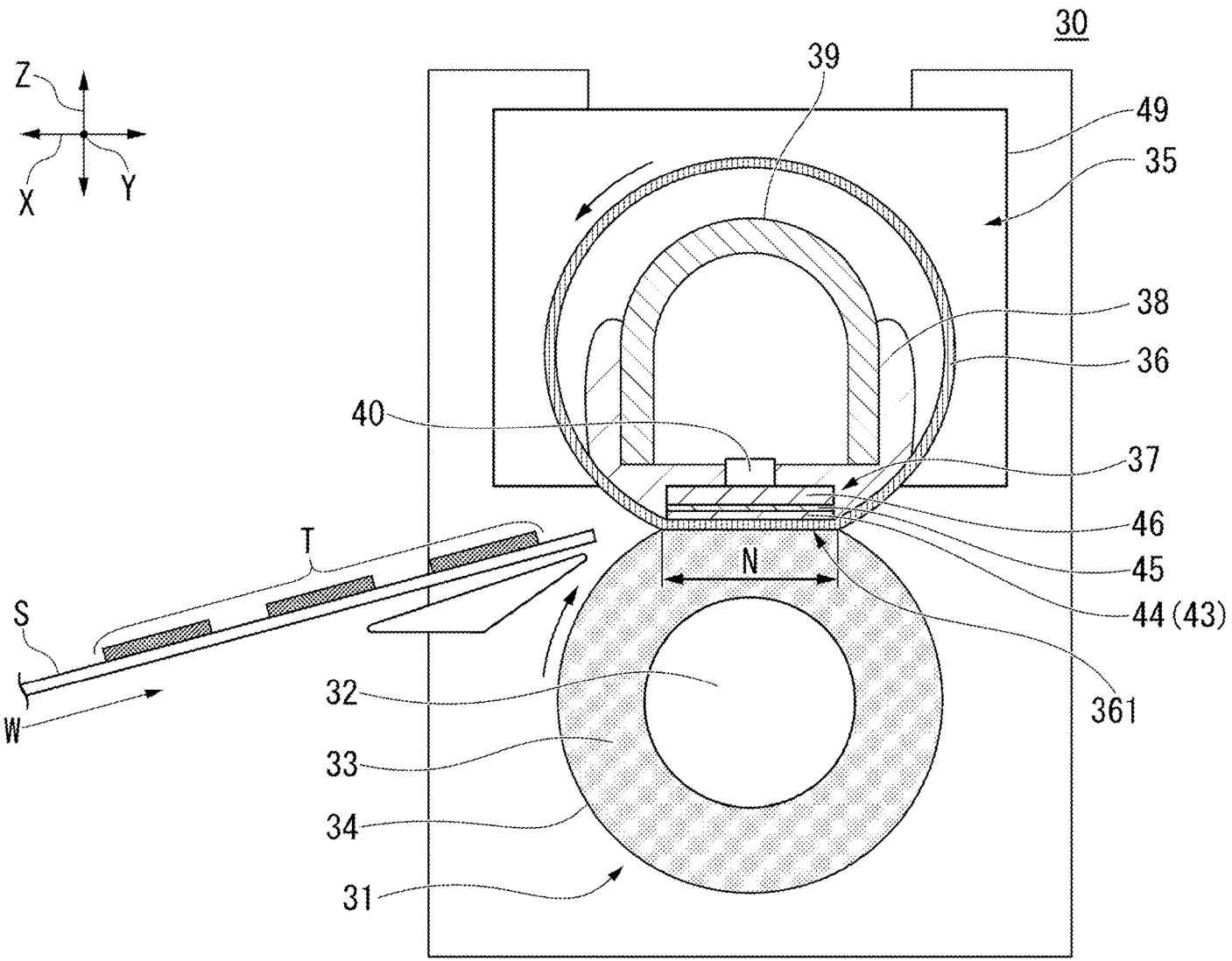
FIG. 3 is an XZ cross-sectional view of a fixing device.

FIG. 3 is an XZ cross-sectional view of the fixing device 30. As illustrated in FIG. 3, the fixing device 30 includes a pressure roller 31 and a heating mechanism 35.

The pressure roller 31 forms a nip N with the heating mechanism 35. The pressure roller 31 presses a toner image T on the sheet S which has entered the nip N. The pressure roller 31 rotates and conveys the sheet S. The pressure roller 31 has a core metal 32, an elastic layer 33, and a release layer 34.

The core metal 32 is made of a metal material such as stainless steel. The core metal 32 has a columnar shape. Both end portions of the core metal 32 in the axial direction are rotatably supported. The core metal 32 is rotationally driven by a motor. The core metal 32 abuts on a cam member. The cam member rotates to bring the core metal 32 closer to and farther away from the heating mechanism 35.

The elastic layer 33 is formed of an elastic material such as silicone rubber. The elastic layer 33 is formed on the outer peripheral surface of the core metal 32 and has a constant thickness. The elastic layer 33 has a cylindrical shape along the core metal 32.

The release layer 34 is formed of a resin material such as PFA (tetrafluoroethylene/perfluoroalkyl vinyl ether copolymer). The release layer 34 is formed on the outer peripheral surface of the elastic layer 33.

The hardness of the outer peripheral surface of the pressure roller 31 is preferably 40° to 70° under a load of 9.8 N under ASKER-Ch. With such characteristics, the nip N can be appropriately provided. In addition, the durability of the pressure roller 31 is sufficient.

The pressure roller 31 can approach and separate from the heating mechanism 35 by the rotation of the cam member. When the pressure roller 31 is brought close to the heating mechanism 35 and pressed by a pressure spring, the nip N is formed. On the other hand, if a sheet S becomes jammed in the fixing device 30, the sheet S can be removed by separating the pressure roller 31 from the heating mechanism 35. Furthermore, during a sleep or idle state in which the tubular body 36 will not be rotating, plastic deformation of the tubular body 36 can be prevented by separating the pressure roller 31 from the heating mechanism 35.

The pressure roller 31 is rotationally driven by a motor to rotate about its axis. If the pressure roller 31 rotates on its axis while the nip N is formed, the tubular body 36 of the heating mechanism 35 is also driven to rotate. The pressure roller 31 rotates on its axis, so the sheet S is conveyed in the conveyance direction W through the nip N.

The heating mechanism 35 heats the toner image T on the sheet S which has entered the nip N. The heating mechanism 35 includes the tubular body 36, a heater unit 37, a support member 38, a stay 39, and a temperature sensor 40.

The tubular body 36 is formed in a tubular shape by a film or the like. The tubular body 36 has flexibility. The tubular body 36 forms the nip N with the pressure roller 31. The tubular body 36 fixes the toner image T onto the sheet S at the nip N.

The tubular body 36 has a base layer, an elastic layer, and a release layer in this order from the inner peripheral side. The base layer is formed of a material such as a polyimide resin. The base layer is tubular. The elastic layer is laminated on the outer peripheral surface of the base layer. The elastic layer is formed of an elastic material such as silicone rubber. The release layer is laminated on the outer peripheral surface of the elastic layer. The release layer is formed of a material such as PFA resin.

Figure 4:
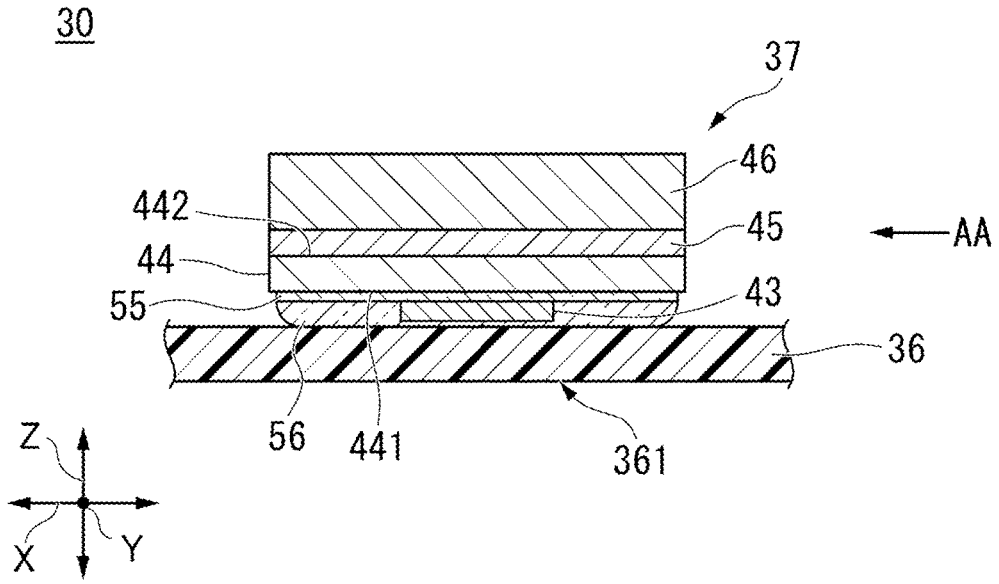
FIG. 4 is an XZ cross-sectional view of a heater unit.
Figure 5:
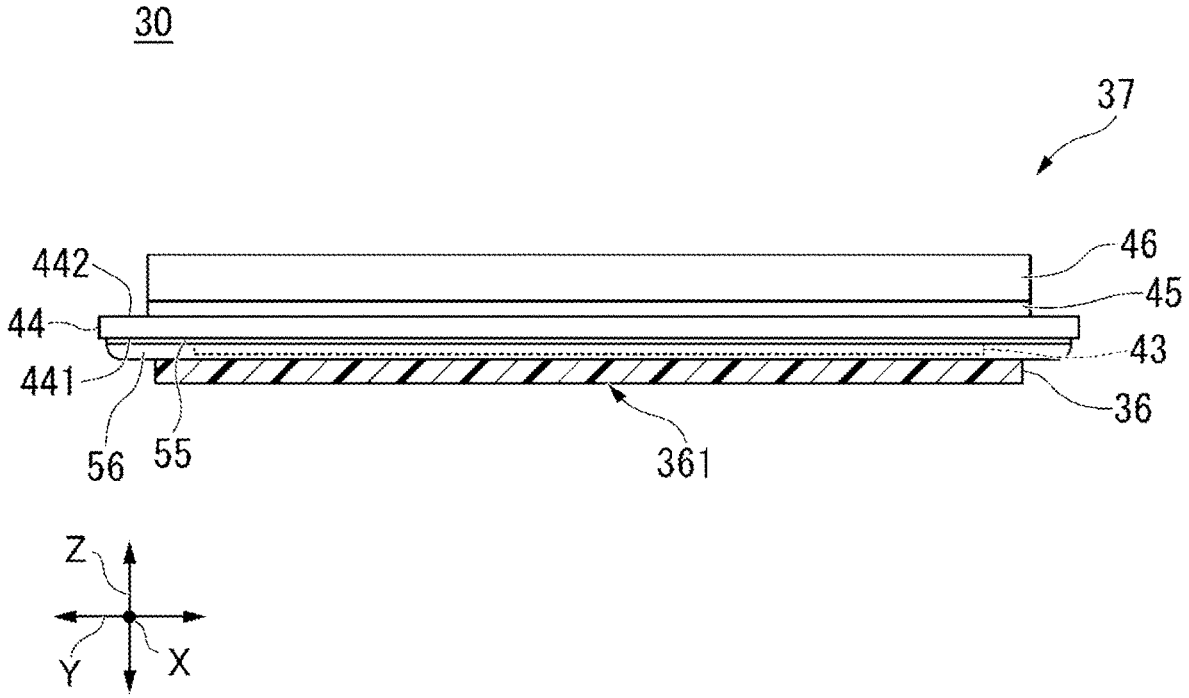
FIG. 5 is a view of the heater unit shown in FIG. 4 when viewed in AA direction.

FIG. 4 is an XZ cross-sectional view of the heater unit 37. FIG. 5 is a view of the heater unit 37 when viewed from AA direction of FIG. 4.

As illustrated in FIG. 4, the heater unit 37 includes a heater 43, a substrate 44, a heat conductive member 45, and a heat equalizing member 46.

The heater 43 is made of a silver/palladium alloy or the like. The heater 43 has a flat plate shape. The heater 43 is arranged inside the tubular body 36. Wiring is connected to the heater 43. If the heater 43 is energized via the wiring, the heater 43 generates heat. The heater 43 faces a heated region 361, which is a part of the tubular body 36. The heater 43 heats the heated region 361. Hereinafter, the direction in which the heated region 361 and the heater 43 face each other is referred to as "first direction Z." The direction along the axial direction of the tubular body 36 is referred to as "second direction Y." The direction orthogonal to the first direction Z and the second direction Y is referred to as "third direction X." The second direction Y is orthogonal to the conveyance direction W.

In the heater unit 37, the heater 43, the substrate 44, the heat conductive member 45, and the heat equalizing member 46 are arranged in this order from the heated region 361 side.

The heater 43 has a thickness in the first direction Z and is long in the second direction Y.

The substrate 44 is formed of a metal material such as stainless steel or a ceramic material such as aluminum nitride. The substrate 44 has a rectangular plate shape. The substrate 44 is arranged inside the tubular body 36. The substrate 44 has a thickness in the first direction Z and is long in the second direction Y.

The substrate 44 is arranged on one side of the heater 43 opposite to the other side on which the heated region 361 is located. The substrate 44 has a first surface 441 and a second surface 442 opposite to the first surface. An insulating layer 55 made by a glass material or the like may be formed on the first surface 441 of the substrate 44. In such a case, the heater 43 and the wiring are arranged on the first surface 441 of the substrate 44 via the insulating layer 55. The heater 43 and the wiring may be covered with a protective layer 56 such as a glass material. The heater 43 is arranged at the center of the substrate 44 in the third direction X.

If the insulating layer 55 covers the first surface 441 of the substrate 44, the edges of the first surface 441 of the substrate 44 in the third direction X do not have to be covered with the insulating layer 55. Thereby, the insulating layer 55 can be prevented from protruding from the side surfaces of the substrate 44 in the third direction X.

As illustrated in FIG. 5, the edges of the first surface 441 of the substrate 44 in the second direction Y may not be covered with the insulating layer 55. As a result, the insulating layer 55 can be prevented from protruding from the side surfaces of the substrate 44 in the second direction Y.

As illustrated in FIG. 4, the protective layer 56 may cover the surface of the insulating layer 55 on the heated region 361 side, including the heater 43. The thickness of the protective layer 56 in the first direction Z is thicker than the thickness of the heater 43 in the first direction Z. The thickness of the protective layer 56 in the first direction Z is thinner than the thickness of the substrate 44 in the first direction Z. The second surface 442 of the substrate 44 opposite to the first surface 441 may also be covered with a protective layer such as a glass material.

The first surface 441 of the substrate 44 does not have to be covered with the protective layer 56. The side surfaces (the side surfaces between the first surface 441 and the second surface 442) of the substrate 44 in the third direction X may be covered with the protective layer 56.

If the protective layer 56 covers the first surface 441 of the substrate 44 including the heater 43, the edges of the first surface 441 of the substrate 44 in the third direction X does not have to be covered with the protective layer 56. As a result, the protective layer 56 can be prevented from protruding from the side surfaces of the substrate 44 in the third direction X.

As illustrated in FIG. 5, the ends of the first surface 441 of the substrate 44 in the second direction Y does not have to be covered with the protective layer 56. As a result, the protective layer 56 can be prevented from protruding from the side surfaces of the substrate 44 in the second direction Y.

The length of the substrate 44 in the second direction Y is longer than the length of the tubular body 36 in the second direction Y. The length of the protective layer 56 in the second direction Y is equal to or less than the length of the substrate 44 in the second direction Y. The length of the protective layer 56 in the second direction Y is longer than the length of the tubular body 36 in the second direction Y. The substrate 44 protrudes from both ends of the tubular body 36 in the second direction Y. The protective layer 56 protrudes from both ends of the tubular body 36 in the second direction Y.

The insulating layer 55 is formed on the first surface 441 of the substrate 44. In such a case, the insulating layer 55 is adjacent to the heater 43 in the first direction Z. Further, both surfaces of the heater 43 in the first direction Z are adjacent to the insulating layer 55 and the protective layer 56. For example, the insulating layer 55 and the protective layer 56 may be made of the same material as each other.

A protective layer may be formed on the second surface 442 of the substrate 44. In such a case, the heat conductive member 45 is adjacent to the protective layer of the second surface 442 in the first direction Z. For example, the protective layer formed on the second surface 442 of the substrate 44 may be made of the same material as the insulating layer 55 and the protective layer 56.

The material of the heat conductive member 45 is graphite. The heat conductive member 45 has a flat plate shape. The heat conductive member 45 has a thickness in the first direction Z. The heat conductive member 45 is long in the second direction. The heat conductive member 45 has an anisotropic thermal conductivity. The heat conductive member 45 is arranged on one side of the substrate 44 opposite to the other side on which the heater 43 is disposed. The heat conductive member 45 faces the heated region 361 via the substrate 44 and the heater 43. The heat conductive member 45 abuts on the second surface 442 of the substrate 44, which is opposite to the first surface 441. The heat conductive member 45 is in direct contact with each of the substrate 44 and the heat equalizing member 46. The heat conductive member 45 is interposed and fixed between the substrate 44 and the heat equalizing member 46 in the first direction by receiving a predetermined pressure.

The heat conductive member 45 has a higher thermal conductivity than the substrate 44. The heat conductive member 45 has a higher thermal conductivity in the second direction Y and the third direction X than the thermal conductivity in the first direction Z. The thickness of the heat conductive member 45 in the first direction Z is in a range of 10 μm to 1000 μm. The thermal conductivity of the heat conductive member 45 in the first direction Z is in a range of 1 W/(m·K) to 20 W/(m·K). The thermal conductivity of the heat conductive member 45 in the second direction Y and the third direction X is in a range of 300 W/(m·K) to 2000 W/(m·K).

The heat equalizing member 46 is made of copper, stainless steel, or the like. The heat equalizing member 46 has a flat plate shape and the heat equalizing member 46 has a thickness in the first direction Z. The heat equalizing member 46 is long in the second direction Y. The heat equalizing member 46 has an isotropic thermal conductivity. The thermal conductivity of the heat equalizing member 46 is almost constant regardless of the direction.

The thickness of the heat equalizing member 46 in the first direction Z is thicker than the thickness of the heat conductive member 45 in the first direction Z. The length of the heat equalizing member 46 in the third direction X is substantially the same as the length of the heat conductive member 45 in the third direction X. In the third direction X, the center of the heat conductive member 45 and the center of the heat equalizing member 46 coincide with each other.

The heat equalizing member 46 is arranged on one side of the heat conductive member 45 opposite to the other side on which the heater 43 and the substrate 44 are disposed. The heat equalizing member 46 averages (smooths) the temperature distribution of the heater 43 via the heat conductive member 45.

As illustrated in FIG. 5, the length of the heat equalizing member 46 in the second direction Y is substantially the same as the length of the heat conductive member 45 in the second direction Y. The length of the heat conductive member 45 in the second direction Y is longer than the length of the heater 43 in the second direction Y. The length of the substrate 44 in the second direction Y is longer than the length of the heat conductive member 45 in the second direction Y.

As illustrated in FIG. 3, the support member 38 is arranged on one side of the heat conductive member 45 or the heat equalizing member 46 opposite to the other side on which the heater 43 and the substrate 44 are disposed. The support member 38 supports the heater 43 or the substrate 44 via the heat conductive member 45 or the heat equalizing member 46. The support member 38 is formed of a resin material such as a liquid crystal polymer. The support member 38 is arranged so as to cover the surface of the heater unit 37 farther from the heated region 361 and both sides of the heater unit 37 in the third direction X. The support member 38 supports the heater unit 37. The support member 38 supports the inner peripheral surface of the tubular body 36 at both end portions of the heater unit 37 in the third direction X.

The stay 39 is formed of a steel plate material or the like. A cross section of the stay 39 perpendicular to the second direction Y is U-shaped. The stay 39 is mounted on a side of the support member 38 farther from the heated region 361 so as to close a U-shaped opening with the support member 38. The stay 39 is long in the second direction Y. Both end portions of the stay 39 in the second direction Y are fixed to the housing 10 of the image forming apparatus 1. As a result, the heating mechanism 35 is supported by the image forming apparatus 1. The stay 39 improves flexural rigidity of the heating mechanism 35. Flanges 49 which restrict the movement of the tubular body 36 in the second direction Y are mounted near both ends of the stay 39 in the second direction Y.

The temperature sensor 40 is arranged on the outer surface of the heater unit 37 farther from the heated region 361. The temperature sensor 40 is arranged inside a hole which penetrates the support member 38 in the first direction Z.

Figure 6:
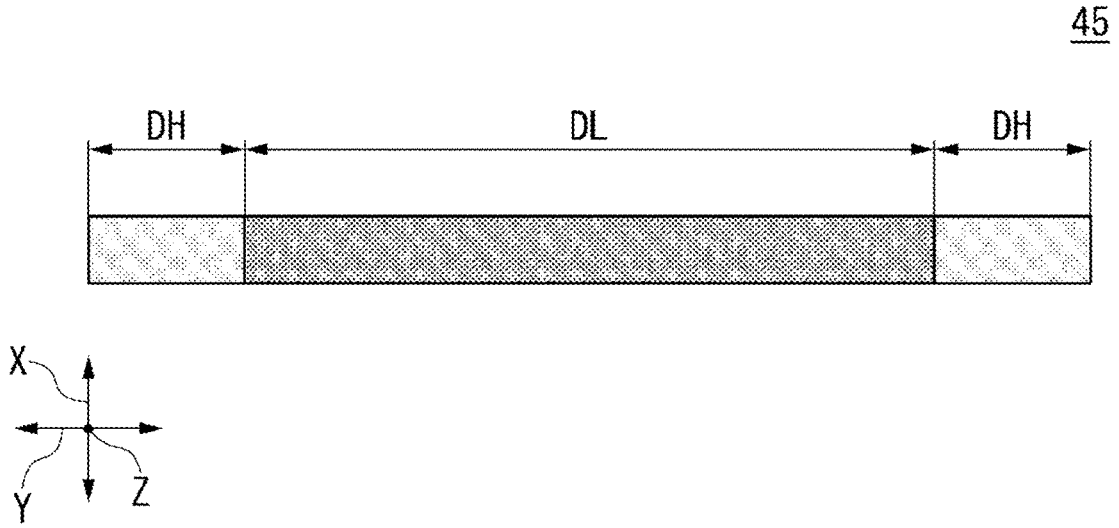
FIG. 6 is a schematic view of a heat conductive member.

FIG. 6 is a schematic view of the heat conductive member 45.

The heat conductive member 45 has a higher density at the end portions in the second direction Y than at the center in the second direction Y. In FIG. 6, in the heat conductive member 45, the regions having a relatively high density are shown by thin hatching (dot hatch sparseness). On the other hand, in the heat conductive member 45, the region having a relatively low density is shown by dark hatching (dot hatch). Hereinafter, the region having a relatively low density in the heat conductive member 45 is referred to as a first region. The region having a higher density than the first region in the heat conductive member 45 is referred to as a second region.

A first region DL is a region which overlaps with a paper passing region through which a small-sized paper passes when viewed from the first direction Z. The first region DL is a region including the central portion of the heat conductive member 45 in the second direction Y. A second region DH is a region which overlaps with a non-paper-passing region through which a small-sized paper does not pass when viewed from the first direction Z. The second region DH is a region including one of the end portions of the heat conductive member 45 in the second direction Y.

As illustrated in FIG. 6, the heat conductive member 45 is one continuous sheet. The heat conductive member 45 is formed by pressing one continuous graphite sheet with a press machine, a rolling roller, or the like in the second direction Y with different pressing conditions. The heat conductive member 45 is formed by making a pressing force on the second region DH larger than a pressing pressure on the first region DL. As a result, the density of the second region DH in the heat conductive member 45 becomes higher than the density of the first region DL.

Usually, a graphite sheet is produced by heat-melting a polymer thin film and graphitizing it. During the manufacturing process of such a graphite sheet, cavities and defects may occur in an internal graphite structure. In such a case, the graphite sheet has a reduced density due to cavities and defects, resulting in a reduced thermal conductivity. When forming the heat conductive member 45, the pressing force on the second region DH is made larger than the pressing force on the first region DL in the graphite sheet. As a result, the density of the second region DH in the heat conductive member 45 is made higher than the density of the first region DL. In the heat conductive member 45, the first region DL has a lower density than the second region DH and has many cavities and defects, so that heat conduction is hindered. On the other hand, in the heat conductive member 45, the second region DH has a higher density than the first region DL and has fewer cavities and defects, so that heat conduction is not hindered.

The surface roughness of the heat conductive member 45 is different between the central portion in the second direction Y and the end portion in the second direction Y. When forming the heat conductive member 45, the pressing force against one continuous graphite sheet is changed between the central portion (first region DL) in the second direction Y and the end portion (second region DH) in the second direction Y by a common press machine or rolling roller. As a result, the surface roughnesses of the first region DL and the second region DH of the heat conductive member 45 are made different from each other.

For example, the surface of the heat conductive member 45 has a waffle pattern. The pattern may be changed between the first region DL and the second region DH in the heat conductive member 45. For example, the heat conductive member 45 may be embossed. The degree of processing may be changed between the first region DL and the second region DH in the heat conductive member 45.

The thickness of the heat conductive member 45 in the first direction Z is different between the central portion in the second direction Y and the end portion in the second direction Y. The heat conductive member 45 has a portion thinned by a high press and a portion remaining thick by a low press. A base material (e.g., a graphite sheet) having the same thickness in the first direction Z over the second direction Y is prepared in advance. When forming the heat conductive member 45, the pressing force on the second region DH in the base material is made larger than the pressing force on the first region DL. Thereby, the thickness in the first direction Z of the second region DH (the end portion in the second direction Y) in the heat conductive member 45 is thinner than the thickness in the first direction Z of the first region DL (the central portion in the second direction Y).

As described above, the fixing device 30 has the tubular body 36, the heater 43, and the heat conductive member 45.

The tubular body 36 forms the nip N with the pressure roller 31. The tubular body 36 is formed in a cylindrical shape. The tubular body 36 fixes the toner image T on the sheet S at the nip N. The heater 43 is arranged inside the tubular body 36. The heater 43 faces the heated region 361, which is a part of the surface of the tubular body 36. The heater 43 heats the heated region 361. The heat conductive member 45 has a larger thermal conductivity in the second direction Y along the axial direction of the tubular body 36 than the thermal conductivity in the first direction Z in which the heater 43 and the heated region 361 face each other. The heat conductive member 45 has a higher density of the second region DH including the end portion in the second direction Y than the density of the first region DL including the central portion in the second direction Y.

According to the fixing device 30, the density of the second region DH is higher than the density of the first region DL in the heat conductive member 45. In the heat conductive member 45, the first region DL has a lower density than the second region DH and has many cavities and defects, so that heat conduction is hindered. On the other hand, in the heat conductive member 45, the second region DH has a higher density than the first region DL and has fewer cavities and defects, so that heat conduction is not hindered. Due to these properties, it is possible to prevent the heat supplied from the heater 43 from passing through the first region DL in the heat conductive member 45 and moving to the opposite side (the heat equalizing member 46 side) of the tubular body 36 from the heated region 361. Therefore, the heat transferred from the heater 43 to the heat equalizing member 46 at the time of paper passing is transferred to the tubular body 36 facing the heater 43. As a result, it is possible to prevent a temperature drop in the central portion of the tubular body 36 in the second direction Y. Therefore, it is possible to prevent the occurrence of fixing failure.

In addition, in the heat conductive member 45, the second region DH has a higher density than the first region DL and has fewer cavities and defects, so that heat can be easily transferred. Therefore, if the temperature of the end portion of the tubular body 36 in the second direction Y rises substantially during continuous paper passing, heat is easily transferred to the heat equalizing member 46, the second direction Y, and the like. As a result, it is possible to prevent the temperature rise at the end portion of the tubular body 36 in the second direction Y and the temperature drop at the central portion in the second direction Y.

The heat conductive member 45 has the following effects because it is one continuous sheet.

The heat conductive member 45 can be formed by pressing one continuous sheet with a press machine, a rolling roller, or the like with different pressing conditions along the second direction Y. When forming the heat conductive member 45, the pressing force on the end portion of one continuous sheet can be made larger than the pressing force on the central portion in the second direction Y. Thereby, in the heat conductive member 45, the density of the end portion can be made higher than the density of the central portion.

The surface roughness of the heat conductive member 45 can be different between the central portion in the second direction Y and the end portion in the second direction Y.

For example, the surface roughness of the heat conductive member 45 may be significantly different between the first region DL and the second region DH so that the surface roughness of the heat conductive member 45 can be visually recognized. Thereby, the first region DL and the second region DH can be visually distinguished from each other in the heat conductive member 45.

The thickness of the heat conductive member 45 in the first direction Z can be different between the central portion in the second direction Y and the end portion in the second direction Y.

For base material having the same thickness in the first direction Z over the second direction Y, the pressing force can be changed between the central portion and the end portion in the second direction Y, in such a manner that a heat conductive member 45 can be formed. Since the base material having the same thickness in the first direction Z along the second direction Y is easily available, the heat conductive member 45 can be easily formed therefrom.

Since the material of the heat conductive member 45 is graphite, the following effects are obtained.

Graphite has a higher thermal conductivity than metal. Therefore, if the temperature of the end portion of the tubular body 36 in the second direction Y rises substantially during continuous paper passing, heat can be more effectively transferred to the heat equalizing member 46, the second direction Y, and the like. As a result, it is possible to prevent the temperature rise more effectively at the end portion of the tubular body 36 in the second direction Y and the temperature drop at the central portion in the second direction Y.

The fixing device 30 includes the substrate 44 arranged on one side of the heater 43 opposite to the other side on which the heated region 361 is located. The heat conductive member 45 is arranged on one side of the substrate 44 opposite to the other side on which the heater 43 is disposed, and thus has the following effects.

The heat supplied from the heater 43 is transferred to the tubular body 36 without passing through the substrate 44 and the heat supplied from the heater 43 is transferred to the heat conductive member 45 via the substrate 44. Therefore, it is possible to promote the transfer of heat to the tubular body 36 facing the heater 43. Therefore, the temperature drop of the tubular body 36 can be prevented more effectively.

The heat equalizing member 46, which averages (smooths) the temperature distribution of the heater 43 via the heat conductive member 45, is arranged on one side of the heat conductive member 45 opposite to the other side on which the heater 43 is disposed. Therefore, the fixing device 30 has the following effects.

Since the heat capacity is increased by the heat equalizing member 46, it is possible to prevent an excessive temperature rise of the entire apparatus.

The support member 38, which supports the heater 43 via the heat conductive member 45, is arranged on one side of the heat conductive member 45 opposite to the other side on which the heater 43 is disposed. Therefore, the fixing device 30 has the following effects.

The heat conductive member 45 and the heater 43 can be supported by the support member 38. For example, by interposing the heat conductive member 45 between the support member 38 and the heater 43 with a predetermined pressure, misalignment of the heat conductive member 45 can be prevented.

Next, a modification example of the first embodiment will be described.

The density of the heat conductive member 45 does not necessarily have to be abruptly changed at the boundary between the first region and the second region. For example, the heat conductive member 45 may have a gradual change in density across the boundary between the first region and the second region. For example, the heat conductive member 45 may gradually increase in density from the central portion toward the end portion in the second direction Y. The heat conductive member 45 may have a third region between the first region and the second region in the second direction Y, which is higher in density than the density of the first region but lower than the density of the second region. The gradual change in density in the second direction Y of the heat conductive member 45 makes it less likely that structural defects will occur during the change in density. Therefore, damage to the heat conductive member 45 can be prevented.

The thickness of the heat conductive member 45 in the first direction Z does not necessarily have to be different between the central portion and the end portion in the second direction Y. For example, the thickness of the heat conductive member 45 in the first direction Z may be the same for the central portion and the end portion in the second direction Y. For example, the thickness of the heat conductive member 45 in the first direction Z may be the same along the second direction Y. As a result, the heat conductive member 45 can be stably supported at any position in the second direction Y. For example, the thickness of the heat conductive member 45 in the first direction Z may be changed according to required specifications.

The heat conductive member 45 does not necessarily have to have different surface roughness between the central portion and the end portion in the second direction Y. For example, the heat conductive member 45 may have the same surface roughness at the central portion and the end portion in the second direction Y. For example, the surface roughness of the heat conductive member 45 may be changed according to required specifications.

Next, a second embodiment will be described with reference to FIG. 7. In the second embodiment, the descriptions of the same elements as the first embodiment will be omitted.

As illustrated in FIG. 6, the heat conductive member 45 of the first embodiment is one continuous sheet. On the other hand, as illustrated in FIG. 7, a heat conductive member 2045 of the second embodiment is different from the first embodiment in that it is divided into two or more portions having different densities in the second direction Y.

Figure 7:
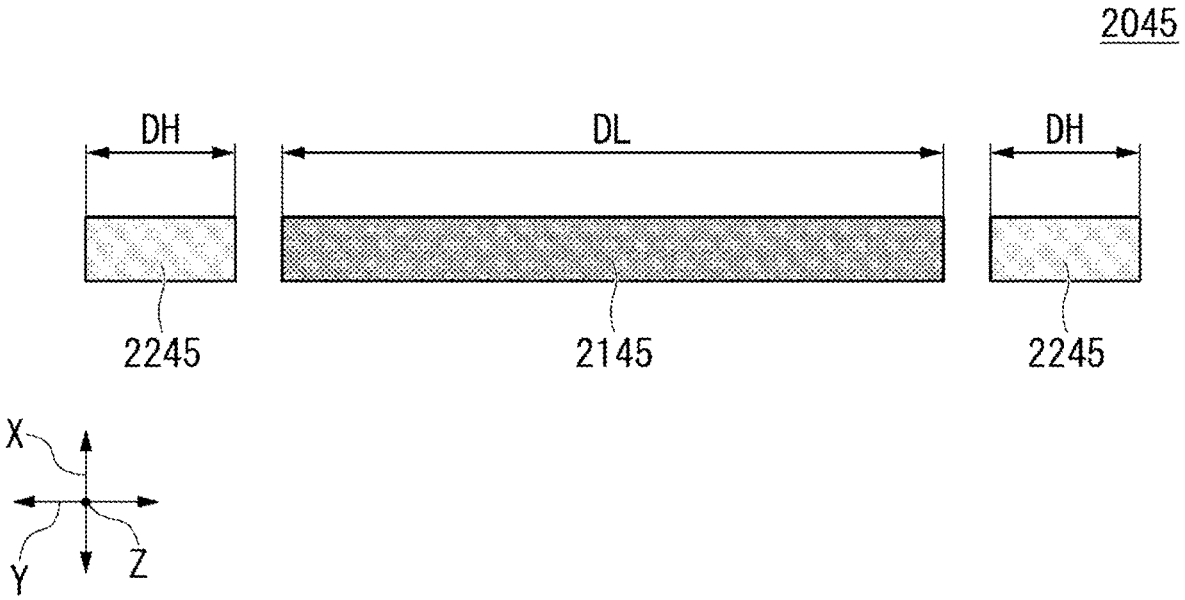
FIG. 7 is a schematic view of a heat conductive member according to a second embodiment.

FIG. 7 is a schematic view of the heat conductive member 2045 of the second embodiment. FIG. 7 is a figure corresponding to FIG. 6 of the first embodiment.

As illustrated in FIG. 7, the heat conductive member 2045 is divided into three members along the second direction Y. In FIG. 7, in the heat conductive member 2045, the members having a relatively high density are shown by thin hatching (dot hatch sparseness). On the other hand, in the heat conductive member 2045, the member having a relatively low density is shown by dark hatching (dot hatch). Hereinafter, the member having a relatively low density among the three members is referred to as a first member. Of the three members, the member having a higher density than the first member is referred to as a second member. The heat conductive member 2045 is composed of one first member 2145 and two second members 2245.

The first member 2145 overlaps with the paper passing region through which the small-sized paper passes when viewed from the first direction Z. The first member 2145 includes the central portion of the heat conductive member 2045 in the second direction Y. The second member 2245 overlaps with the non-paper-passing region through which the small-sized paper does not pass when viewed from the first direction Z. The second member 2245 includes one of the end portions of the heat conductive member 2045 in the second direction Y.

The first member 2145 and the second members 2245 are graphite sheets having different densities. The density of each second member 2245 is higher than the density of the first member 2145. The region in which the first member 2145 is arranged in the heat conductive member 2045 corresponds to a first region DL. The region in which the second member 2245 is arranged in the heat conductive member 2045 corresponds to a second region DH. In the heat conductive member 2045, the first region DL has a lower density than the second region DH and has many cavities and defects, so that heat conduction is hindered. On the other hand, in the heat conductive member 2045, the second region DH has a higher density than the first region DL and has fewer cavities and defects, so that heat conduction is not hindered.

FIG. 7 shows the three members separated from each other with gaps in the second direction Y. However, the three members may be preferably in contact with each other in the second direction Y. As a result, heat conduction is not hindered by a gap, so that the heat conduction in the second direction Y can be improved in the heat conductive member 2045.

According to the second embodiment, the heat conductive member 2045 is divided into two or more portions having different densities in the second direction Y. Therefore, the heat conductive member 2045 has the following effects.

Unlike a heat conductive member formed of one continuous sheet, it is not necessary to adjust the density of the heat conductive member 2045 with a press machine or a rolling roller. For example, the heat conductive member 2045 can be easily formed by combining two or more members having different densities from each other.

Next, a modification example of the second embodiment will be described.

The heat conductive member 2045 does not necessarily have to be divided into three members in the second direction. For example, the heat conductive member 2045 may be divided into four or more members in the second direction. The number of divisions of the heat conductive member 2045 may be changed according to required specifications.

A contact portion (hereinafter referred to as "member contact portion") of two members adjacent to each other in the second direction Y does not necessarily have to be flat when viewed from the first direction Z. For example, the member contact portion may be wavy or jagged when viewed from the first direction Z. For example, of the first member and the second member adjacent to each other in the second direction, the first member may have a triangular convex portion protruding toward the second member when viewed from the first direction Z. In such a case, the second member may have a concave portion that can be engaged with the triangular convex portion when viewed from the first direction Z. According to these configurations, it is possible to prevent the misalignment of two members adjacent to each other in the second direction Y from occurring. The shape of the member contact portion may be changed according to required specifications.

Next, a third embodiment will be described with reference to FIG. 8. In the third embodiment, the descriptions of the same elements as the first embodiment will be omitted.

As illustrated in FIG. 4, the heater unit 37 of the first embodiment includes one heat conductive member 45. On the other hand, as illustrated in FIG. 8, a heater unit 3037 of the third embodiment is different from the first embodiment in that it includes a plurality of heat conductive members 3045.

Figure 8:
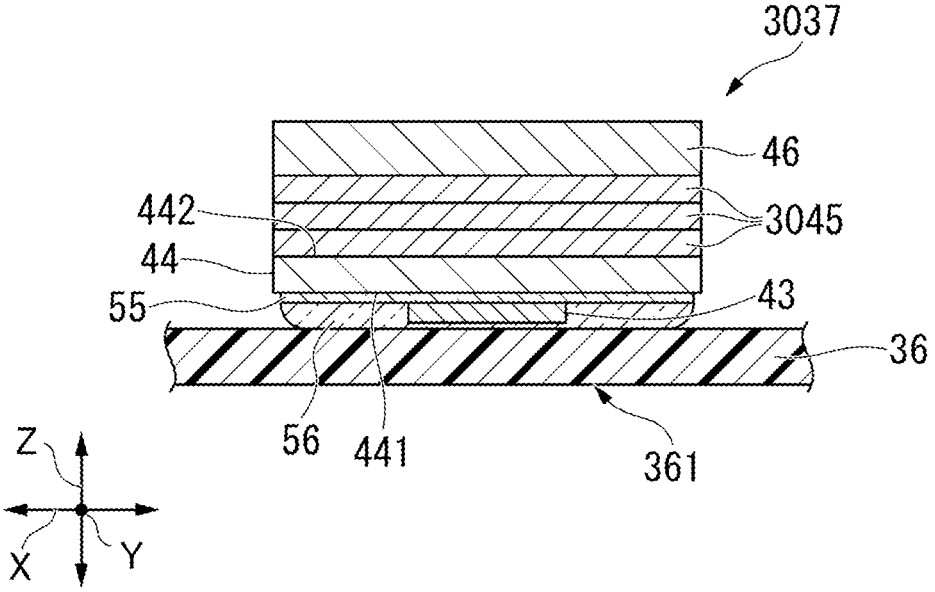
FIG. 8 is an XZ cross-sectional view of a heater unit according to a third embodiment.

FIG. 8 is an XZ cross-sectional view of the heater unit 3037 of the third embodiment. FIG. 8 is a figure corresponding to FIG. 4 of the first embodiment.

As illustrated in FIG. 8, the heater unit 3037 includes three heat conductive members 3045. The three heat conductive members 3045 are stacked along the first direction Z. The three heat conductive members 3045 have the same shape as each other. Each of the three heat conductive members 3045 may be the same as the heat conductive member 45 of the first embodiment illustrated in FIG. 4.

According to the third embodiment, the heater unit 3037 includes the plurality of heat conductive members 3045. The plurality of heat conductive members 3045 are stacked along the first direction Z to obtain the following effects.

Since a heat capacity is increased by the plurality of heat conductive members 3045, it is possible to prevent the temperature rise more effectively at the end portion of the tubular body 36 in the second direction Y.

Next, a fourth embodiment will be described with reference to FIG. 9. In the fourth embodiment, the descriptions of the same elements as the first embodiment will be omitted.

As illustrated in FIG. 4, the heat equalizing member 46 of the first embodiment has a flat plate shape. On the other hand, as illustrated in FIG. 9, a heat equalizing member 4046 of the fourth embodiment is different from the first embodiment in that it has a recess portion 4461 in the surface facing the heat conductive member 45.

Figure 9:
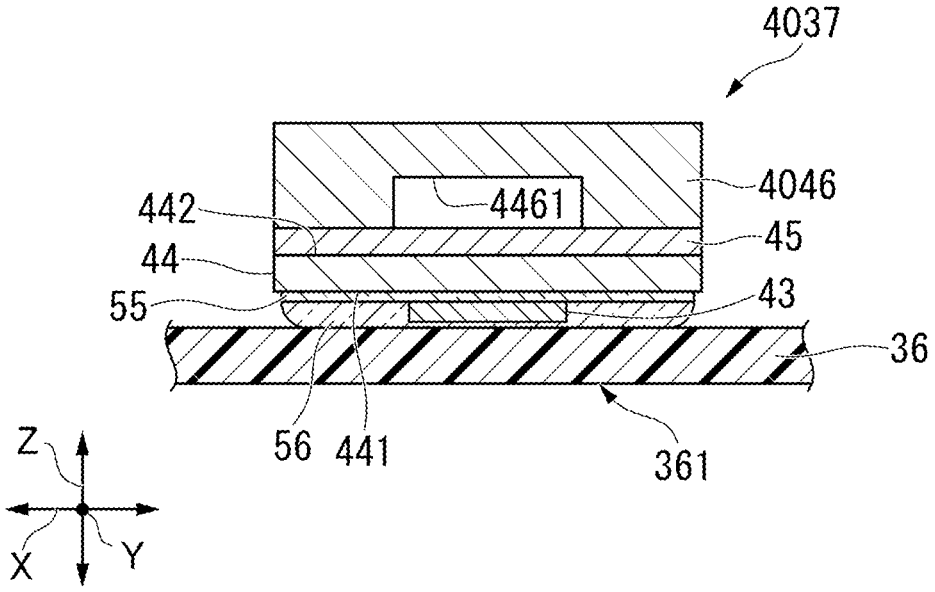
FIG. 9 is an XZ cross-sectional view of a heater unit of a fourth embodiment.

FIG. 9 is an XZ cross-sectional view of a heater unit 4037 of the fourth embodiment. FIG. 9 is a figure corresponding to FIG. 4 of the first embodiment.

As illustrated in FIG. 9, the heat equalizing member 4046 has the recess portion 4461 in the surface facing the heat conductive member 45. The recess portion 4461 is formed so as to have a width corresponding to a width of the heater 43 in the second direction Y. The recess portion 4461 penetrates the heat equalizing member 4046 in the second direction Y. The bottom surface of the recess portion 4461 is not in contact with the heat conductive member 45. On the other hand, both sides of the heat equalizing member 4046 in the third direction X with respect to the recess portion 4461 are in contact with the heat conductive member 45.

If printing is started in the image forming apparatus 1, the heater 43 raises the temperature of the tubular body 36 to a fixing temperature. If the heater 43 generates heat from room temperature, for example, the temperature distribution of the heater 43 is highest at the center of the heater 43 in the third direction X. The temperature distribution of the heater 43 gradually decreases as a distance from the center of the heater 43 increases in the third direction X. As described above, the temperature distribution of the heater 43 has a mountain shape. The recess portion 4461 of the heat equalizing member 4046 is formed so as to cover the center of the heater 43 in the third direction X, which corresponds to the temperature peak.

According to the fourth embodiment, the heat equalizing member 4046 has the recess portion 4461 in the surface facing the heat conductive member 45. Therefore, the heat equalizing member 4046 has the following effects.

Since the bottom surface of the recess portion 4461 is not in contact with the heat conductive member 45, most of the heat generated by the heater 43 is transferred to the tubular body 36 instead of being transferred to the heat equalizing member 4046. Since the tubular body 36 is efficiently heated, the time until the start of printing can be shortened. Therefore, it is possible to prevent the recovery time of the image forming apparatus 1 from becoming long.

According to the fourth embodiment, the recess portion 4461 penetrates the heat equalizing member 4046 in the second direction Y. Thus, the heat generated by the heater 43 can be transferred to the tubular body 36 without being transferred to the heat equalizing member 4046 at any position in the second direction Y. Since the tubular body 36 is heated more efficiently, the time to start printing can be shortened.

Next, a modification will be described.

The heater 43 does not necessarily have to face the nip. For example, the heater 43 may face the heated region, which is a part of the surface of the tubular body 36. For example, the location of the heater 43 may be changed according to required specifications.

The pressure roller 31 may be any pressing member. For example, a pressing member that is not cylindrical (e.g., a rectangular parallelepiped shape) may be used instead. The pressing member may have any shape which forms a nip together with the tubular body 36. For example, the shape and other aspects of the pressing member may be changed or altered according to required specifications.

The material of the heat conductive member 45 is not limited to graphite. For example, the material of the heat conductive member 45 may be a metal such as copper or aluminum. For example, the material of the heat conductive member 45 may be changed according to required specifications.

The fixing device 30 does not necessarily have to have the substrate 44 arranged on one side of the heater 43 opposite to the other side on which the heated region is located. For example, the fixing device 30 may include the substrate 44 located between the heater 43 and the heated region. In such a case, the heater 43 is located on the side of the substrate 44 on which the heated region is located. The arrangement of the heater 43 and the substrate 44 may be changed according to required specifications.

The heat conductive member 45 does not necessarily have to be placed on the side of the substrate 44 opposite to the side thereof on which the heater 43 is disposed. For example, the heat conductive member 45 may be arranged on the same side of the substrate 44 on which the heater 43 is disposed. The arrangement of the heat conductive member 45 may be changed according to required specifications.

The fixing device 30 does not necessarily have to have the heat equalizing member 46 which is arranged on the side of the heat conductive member 45 opposite to the side thereof on which the heater 43 is disposed for averaging the temperature distribution of the heater 43 via the heat conductive member 45. For example, the fixing device 30 does not have to have the heat equalizing member 46. For example, the heat conductive member 45 may be interposed between the heater 43 and the support member 38. If there is no heat equalizing member 38, the heat capacity decreases and the temperature of the entire apparatus tends to rise. Therefore, it is possible to prevent a temperature drop during paper passing. For example, the arrangement of the heat equalizing member 46 may be changed according to required specifications.

The fixing device 30 does not necessarily have to have the support member 38 which is arranged on the side of the heat conductive member 45 opposite to the side thereof on which the heater 43 is disposed for supporting the heater 43 via the heat conductive member 45. For example, the fixing device 30 does not have to have the support member 38. In such a case, the stay 39 may be configured to support the heater 43 via the heat conductive member 45. For example, the arrangement of the support member 38 may be changed according to required specifications.

The heat conductive member 45 does not necessarily have to be fixed at a particular position by being interposed between the substrate 44 and the heat equalizing member 46 by predetermined forces. For example, the heat conductive member 45 may be fixed at a fixed position with a double-sided tape or an adhesive. For example, the heat conductive member 45 may be fixed at a fixed position by surface tension due to a liquid such as silicone oil. The fixing aspect of the heat conductive member 45 may be changed according to required specifications.

According to at least one embodiment described above, the fixing device 30 has the tubular body 36, the heater 43, and the heat conductive member 45. The tubular body 36 forms the nip N with the pressing member 31. The tubular body 36 is formed in a cylindrical shape. The tubular body 36 fixes the recording material T onto the sheet S at the nip N. The heater 43 is arranged inside the tubular body 36. The heater 43 faces the heated region 361, which is a part of the surface of the tubular body 36. The heater 43 heats the heated region 361. The heat conductive member 45 has the larger thermal conductivity in the second direction Y along the axial direction of the tubular body 36 than the thermal conductivity in the first direction Z in which the heater 43 and the heated region 361 face each other. The heat conductive member 45 has a higher density at the end portion in the second direction Y than at the central portion in the second direction Y.

According to the fixing device 30 of the above-described embodiments, the density of the end portion of the heat conductive member 45 in the second direction Y is higher than the density of the central portion in the second direction Y. In the heat conductive member 45, the central portion has a lower density than the end portion in the second direction Y and tends to have many cavities and defects, so that heat conduction is hindered in the central portion. On the other hand, the end portion in the second direction Y of the heat conductive member 45 has a higher density than the central portion in the second direction Y and tends to have fewer cavities and defects, so that heat conduction is not hindered in this portion. Due to these properties, it is possible to prevent the heat supplied from the heater 43 from passing through the central portion in the heat conductive member 45 in the second direction Y and moving to the opposite side of the tubular body 36 from the heated region 361. Therefore, the heat transferred from the heater 43 to the side opposite to the heated region 361 at the time of paper passing is transferred to the tubular body 36 facing the heater 43. As a result, it is possible to prevent a temperature drop in the central portion of the tubular body 36. Therefore, it is possible to prevent the occurrence of fixing failures.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:

a tubular body that forms a nip with a pressure member to fix a recording material onto a recording medium;

a heater inside the tubular body and facing a heated region of the tubular body in a first direction;

a heat conductive member that has a thermal conductivity larger in a second direction parallel to an axial direction of the tubular body than in the first direction;

a substrate between the heat conductive member and the heater; and a support that supports the heater via the heat conductive member, wherein the heat conductive member includes an end portion and a central portion along the second direction, and the end portion has a higher density than the central portion.

2. The fixing device according to claim 1, wherein the heat conductive member is one continuous sheet.

3. The fixing device according to claim 1, wherein the end and central portions are separated from each other.

4. The fixing device according to claim 1, wherein a thickness of the heat conductive member in the first direction is the same along the second direction.

5. The fixing device according to claim 1, wherein the end portion has a surface roughness different from the central portion.

6. The fixing device according to claim 1, wherein the end portion has a thickness different from the central portion in the second direction.

7. The fixing device according to claim 1, wherein the heat conductive member is made of graphite.

8. The fixing device according to claim 1, further comprising:

a heat equalizing member on the heat conductive member by which a temperature distribution of the heater is averaged via the heat conductive member.

9. An image forming apparatus, comprising:

an image forming unit configured to form an image on a recording medium using a recording material; and a fixing device including:

a tubular body that forms a nip with a pressure member to fix the image onto the recording medium, a heater inside the tubular body and facing a heated region of the tubular body in a first direction, a heat conductive member that has a thermal conductivity larger in a second direction parallel to an axial direction of the tubular body than in the first direction, a substrate between the heat conductive member and the heater, and a support that supports the heater via the heat conductive member, wherein the heat conductive member includes an end portion and a central portion along the second direction, and the end portion has a higher density than the central portion.

10. The image forming apparatus according to claim 9, wherein the heat conductive member is one continuous sheet.

11. The image forming apparatus according to claim 9, wherein the end and central portions are separated from each other.

12. The image forming apparatus according to claim 9, wherein a thickness of the heat conductive member in the first direction is the same along the second direction.

13. The image forming apparatus according to claim 9, wherein the end portion has a surface roughness different from the central portion.

14. The image forming apparatus according to claim 9, wherein the end portion has a thickness different from the central portion in the second direction.

15. The image forming apparatus according to claim 9, wherein the heat conductive member is made of graphite.

16. The image forming apparatus according to claim 9, wherein the fixing device further includes a heat equalizing member on the heat conductive member by which a temperature distribution of the heater is averaged via the heat conductive member.

17. A fixing device, comprising:

a tubular body that forms a nip with a pressure member to fix a recording material onto a recording medium;

a heater inside the tubular body and facing a heated region of the tubular body in a first direction;

a heat conductive member that has a thermal conductivity larger in a second direction parallel to an axial direction of the tubular body than in the first direction; and a support that supports the heater via the heat conductive member, wherein the heat conductive member includes an end portion and a central portion along the second direction, and the end portion has a higher density than the central portion.

* * * * *